US005224891A

United States Patent [19]

Stephens

[11] Patent Number: 5,224,891

[45] Date of Patent: Jul. 6, 1993

[54] RECREATIONAL INSERT FOR INNER TUBE

[75] Inventor: William C. Stephens, Mill Valley, Calif.

[73] Assignee: Aquatic Diversions, Inc., Orinda, Calif.

[21] Appl. No.: 790,161

[22] Filed: Nov. 12, 1991

[51] Int. Cl.[5] ..... B63B 35/74

[52] U.S. Cl. ..... 441/130; 114/363

[58] Field of Search ..... 114/363, 345, 346, 361; 441/129-132, 37, 40, 81

[56] References Cited

U.S. PATENT DOCUMENTS

| | | | |
|---|---|---|---|
| 2,618,285 | 11/1952 | Heisig | 114/361 X |
| 2,761,155 | 9/1956 | Headley | 441/40 |
| 2,804,123 | 8/1957 | Kling | 114/363 X |
| 3,048,859 | 8/1962 | Maillot | 441/37 |
| 3,099,845 | 8/1963 | Chamberlain | 441/81 |
| 3,102,280 | 9/1963 | Williams | 441/130 |
| 3,117,327 | 1/1964 | Mathew | 441/132 |
| 4,367,689 | 1/1983 | Lukehart et al. | 114/346 |
| 4,516,943 | 5/1985 | Spieldiener | 114/346 X |
| 4,564,240 | 1/1986 | Thieme | 441/129 X |

*Primary Examiner*—Sherman Basinger

*Attorney, Agent, or Firm*—Burns, Doane, Swecker & Mathis

[57] ABSTRACT

An insert for an inflatable, buoyant toroid has a bottom portion with one or more contoured, concave surfaces radially disposed about a circular base and one or more seating portions above the bottom portion. The center of gravity of the insert is on a vertical axis passing substantially through the center of the circular base whether the insert contains a passenger or not. A flotation device comprising the insert and an inflatable, buoyant toroid has positive stability in water. The center of gravity of the insert is adjusted by a ballasting apparatus. The insert is provided with a variety of comfort enhancing options. The insert includes fastening devices for fastening the insert to an inflatable buoyant toroid. An insert can be provided with a top portion including an access door for using the insert as an equipment storage device.

19 Claims, 5 Drawing Sheets

RECREATIONAL INSERT FOR INNER TUBE

BACKGROUND OF THE INVENTION

1. Field of the Invention

The present invention relates to a recreational floating device and, more specifically, to a device for insertion in an inner tube for use in river rafting or "tubing".

2. Brief Description of the Prior Art

The sport of "tubing" has gained increasing popularity in recent years. An automotive inner tube is used as a floating seat to support a person in water. Normally, the person will place legs, arms and upper back over the top of the tube, and permit lower back and bottom to protrude through the tube into the water. When the body of water is a river, particularly one with small rapids, an exhilarating and enjoyable experience can be had.

Inner tubes are the chosen device for tubing for a number of reasons including their availability and their minimal cost, and floating on a body of water without using an inner tube cannot properly be called "tubing". As a consequence, the equipment used for tubing has remained fairly constant over the years, rarely comprising anything beyond an inner tube.

Several drawbacks to the use of an unadorned inner tube for tubing were identified in U.S. Pat. No. 4,795,387 to Morgan. These drawbacks include the possibility of tubes being too large or too small for comfortable use, the possibility of collisions of parts of the user, such as the user's lower back and bottom, with rocks or other obstacles. The common difficulty of finding sources of compressed air near remote bodies of water for inflating and deflating a tube in order to insert or detach a device capable of overcoming the other problems is also mentioned. Morgan addresses these problems by proposing a collapsible inner tube seat support that deforms an inner tube along a longitudinal axis. The solution offered by Morgan, however, risks puncturing the inner tube in use and decreases the stability of the device as deformation is increased. Further, the Morgan device appears to be rather spartan and not particularly well suited for comfort and relaxed enjoyment on extended length rides.

Using a tube insert to provide additional safety, comfort and support raises further problems of raft stability. When a plain inner tube in used, there is rarely any problem of stability because the combined center of gravity of the tube and passenger is low. However, as inserts deform an inner tube longitudinally, as in Morgan, or rise significantly above the water, as in U.S. Pat. No. 3,666,265 to Ammerman et al., which discloses a water seesaw device, the risk of an inadvertent tipping of the device is increased because the device's stability is decreased. This risk is increased when a passenger of a size not intended for the device uses the device, or a passenger positions him or herself in an unconventional manner on the craft. One solution proposed by U.S. Pat. No. 4,771,722 to Tihany is to provide a frame to support a seat and outrigger arms for outrigger devices. Tihany, of course, has the disadvantage of requiring a good deal of assembly and of requiring numerous additional parts. In addition to the foregoing difficulties, the devices described appear to be rather heavy, thus risking injury to an individual who is inadvertently struck by one of the devices. It is therefore desirable to have a tubing device that is normally light in weight, both for safety and for transportation purposes.

If a safe, comfortable and stable device is possible, long trips, such as weekend camping expeditions are made more possible, and it is therefore desirable to have a tubing device in which camping gear can be stored and carried along. With longer trips being possible, it is also therefore desirable to provide a variety of comfort-enhancing options. It will also be desirable to provide a device for use with larger inner tubes that can support one or more passengers comfortably, safely and with stability.

BRIEF SUMMARY OF THE INVENTION

An insert for an inner tube or similar device comprising a bottom portion with one or more contoured, concave surfaces adapted for contacting a portion of the surface of the inner tube radially disposed about an extended base adapted for fitting into the center opening of the inner tube and a seating portion disposed above the bottom portion. The insert has a center of gravity located substantially on a vertical axis passing substantially through the center of the base, whether the location of the center of gravity is determined based upon the insert alone or upon the insert and a normal sized passenger seated in the insert in a normal fashion. Further, when the insert is used in conjunction with an inner tube, the combination results in a flotation device that has positive stability. The seating portion is provided with or without armrests. The base is preferably circular, but may be any shape which fits or wedges into the center opening of the inner tube.

The present invention also provides ballasting means for adjusting the locations of the center of gravity and the center of buoyancy of the insert to accommodate different passenger requirements and positions. The ballasting means may comprise a number of separate compartments formed between the bottom portion and the seat. Preferably, the separate compartments are each provided with a means for a passenger or other person to fill or drain the compartments with water as needed for a desired ballast. The compartments can also be adapted to use solid ballast, such as sand, rocks or metal, if desired.

In another embodiment of the present invention, the insert is provided with a plurality of fastening means for fastening the insert securely to an inner tube. The fastening means are located radially around the periphery of the insert. Alternative fastening means can comprise the shape or size of the base which adequately secures the insert into the inner tube. For example, the base can be flared at the lower portion to engage the opposite side of the inner tube. The flared base may be a portion of or the entire perimeter of the base and can be sized and shaped so it can be popped into and out of the inner tube or can be sized and shaped for rugged use such that the inner tube would need be deflated and reinflated around the base member of the insert.

In further embodiments of the present invention, inserts are provided with one or more storage compartments between the seat backrest and the bottom portion, the storage compartments being waterproof in one embodiment. In other embodiments, inserts are provided with features such as beverage holders, umbrella holders, grips and/or oarlocks and radio or speaker holders.

In another embodiment of the present invention, the insert includes more than one seat. In a preferred embodiment, all seats face in the same direction. In another embodiment, the seats face, alternately, in opposite directions. An insert with more than one seat may include an armrest at left and right sides of the seating means with an armrest separating individual seats. Alternatively, no armrests are used. The seat arrangement can be side by side or can provide for in-line seating, e.g., like toboggan seating.

In another embodiment of the present invention, a bottom portion including one or more contoured, concave surfaces radially disposed about a circular base is covered with a top portion including an access means to form an interior portion suitable for storing equipment. This embodiment is used to transport articles in a tube separate from the tube in which an individual is seated.

This invention possesses many other advantages and has other purposes which will become apparent to other upon reading and understanding the following detailed description of the invention.

BRIEF DESCRIPTION OF THE DRAWINGS

The invention may take many forms. The drawings are only for purposes of illustrating preferred embodiments of the invention and are not to be construed as limiting it.

DETAILED DESCRIPTION OF THE INVENTION

Figure 1:
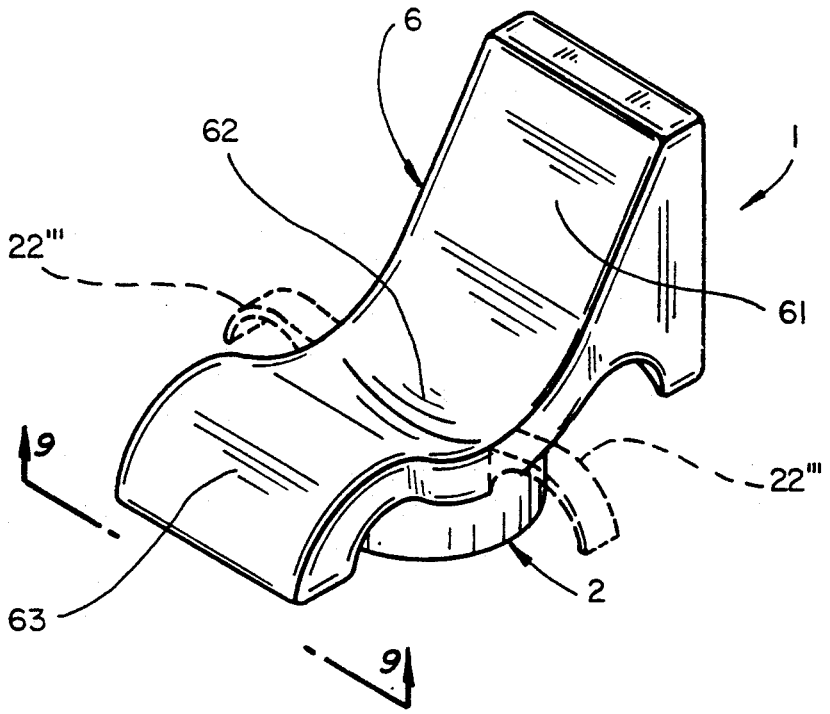
FIG. 1 shows a perspective view of an insert.
Figure 2:
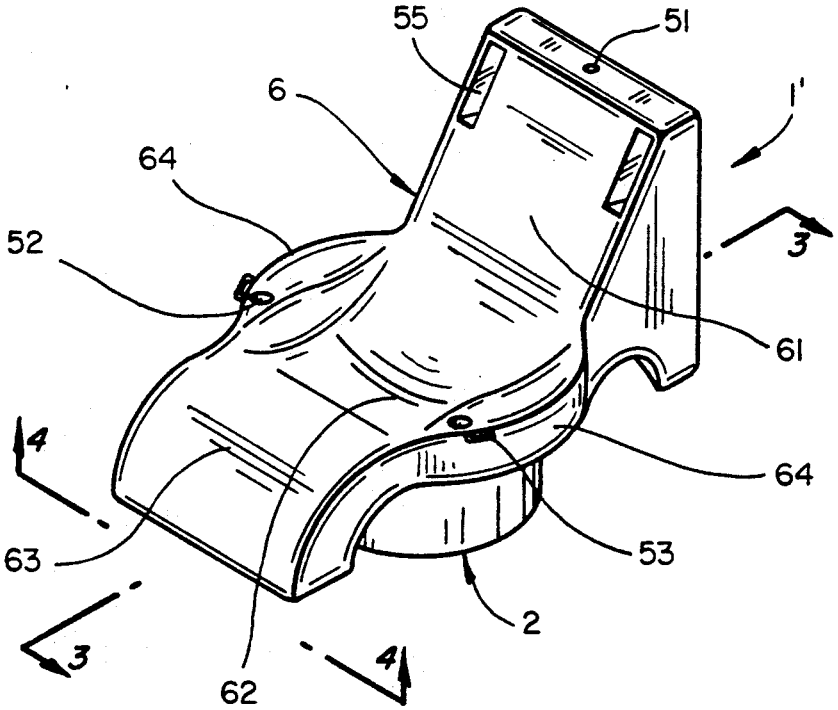
FIG. 2 shows a perspective view of an insert with several optional features.

An insert 1 for an inner tube is shown in FIG. 1. FIG. 2 shows an insert 1' with armrests 64 and several additional features such as an umbrella holder 51, a beverage holder 52, and two hand grips 53. The seating portion 6 and the bottom portion 2 comprise a single, molded piece. The insert 1 may be a hollow shell manufactured from a material such as polypropylene or polyethylene in a rotational molding process, or it may be a solid piece, manufactured in an injection molding process from a material such as styrofoam or some other material, preferably one with buoyant characteristics. Additional construction possibilities will be described in relation to other embodiments of the invention.

Figure 3:
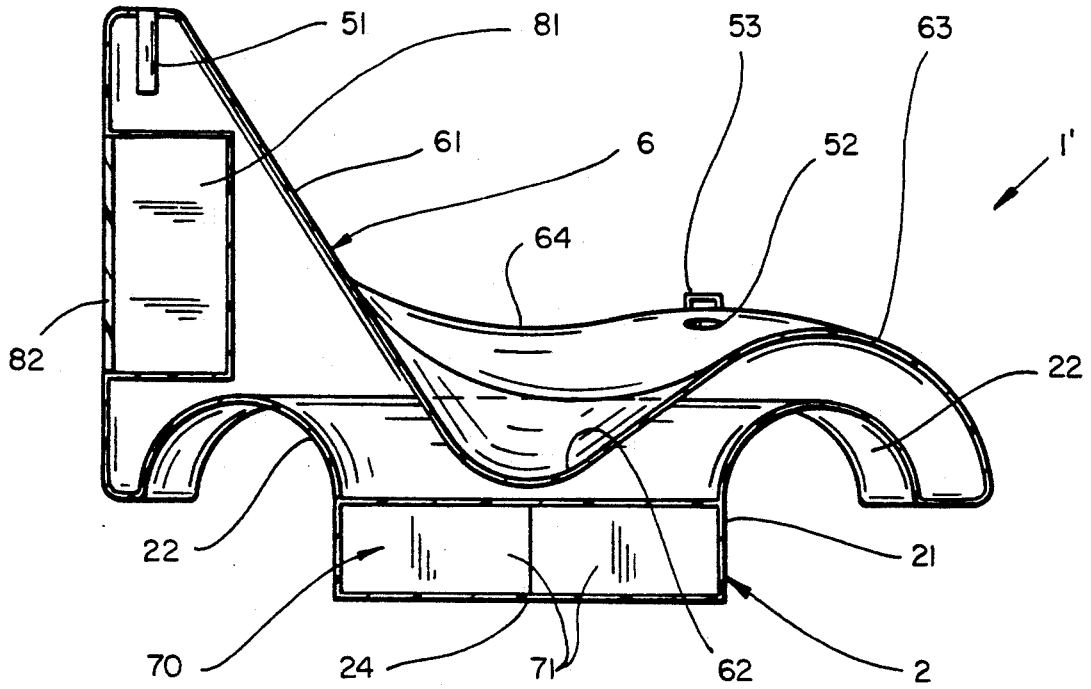
FIG. 3 shows a cross-sectional side view of an insert.
Figure 6:
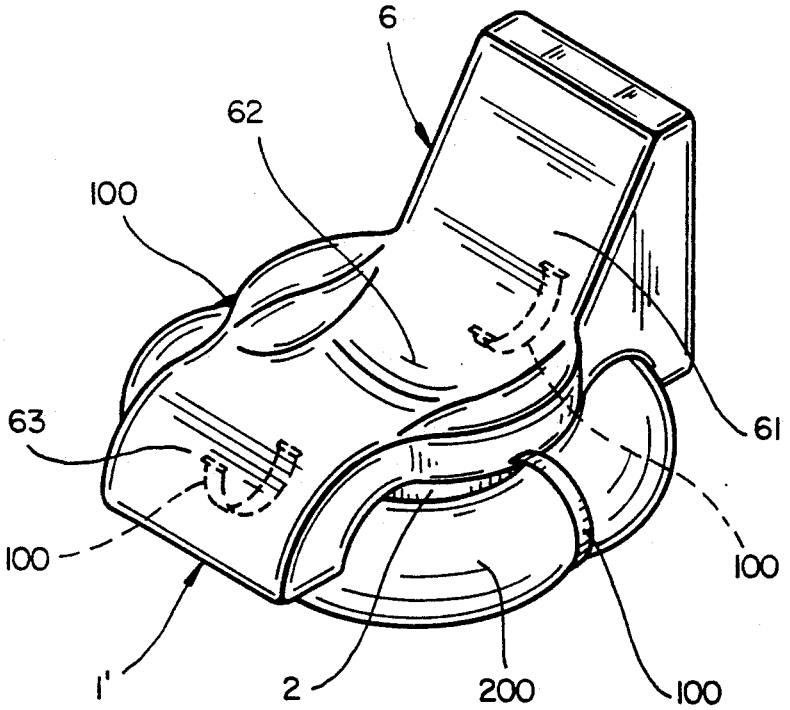
FIG. 6 shows a perspective view of a flotation device.

The seating portion 6 depicted in FIG. 3 is molded in the form of a reclining chair including a backrest 61, a seat 62, a legrest 63 and two armrests 64. The seating portion 6 is positioned over a bottom portion 2. The bottom portion 2 includes a circular base 21. The circular base 21 is a diameter to fit through a particular automotive inner tube's (not shown) center hole. The circular base will, of course, also fit through the center hole of a larger diameter inner tube, and inserts 1 are manufactured in a variety of sizes to accommodate different standard inner tube sizes and different sized passengers. FIG. 6 shows an insert 1 with four fastening straps 100 used in conjunction with an inner tube larger than the inner tube 200 for which the insert is designed.

Figure 4:
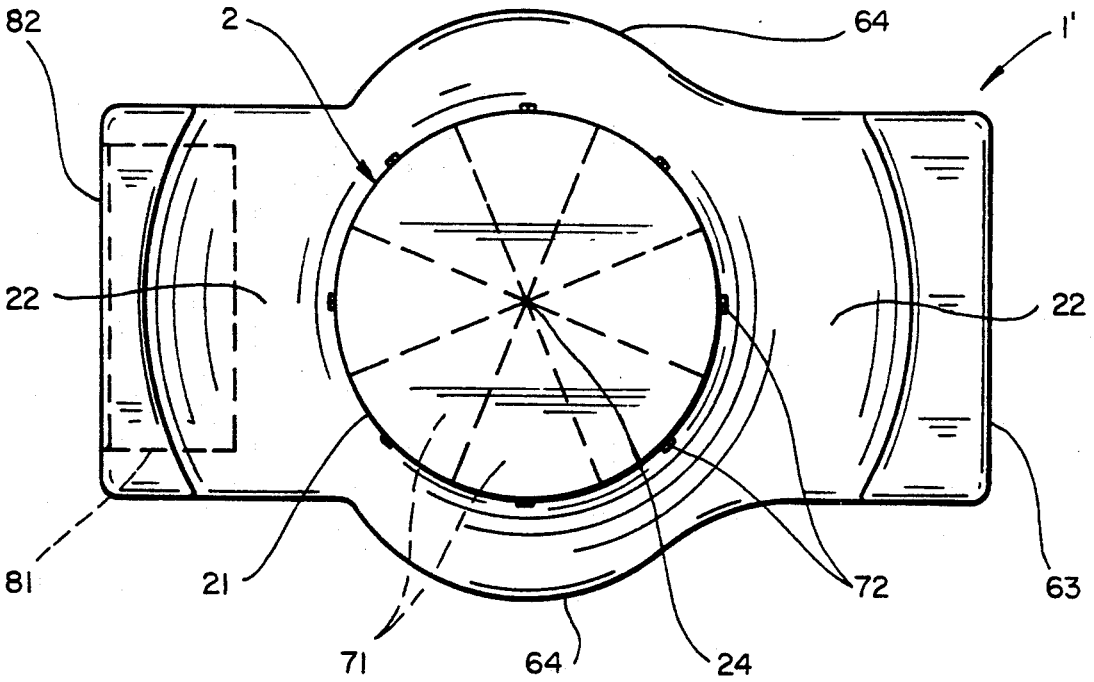
FIG. 4 shows a bottom view of an insert with armrests.
Figure 5:
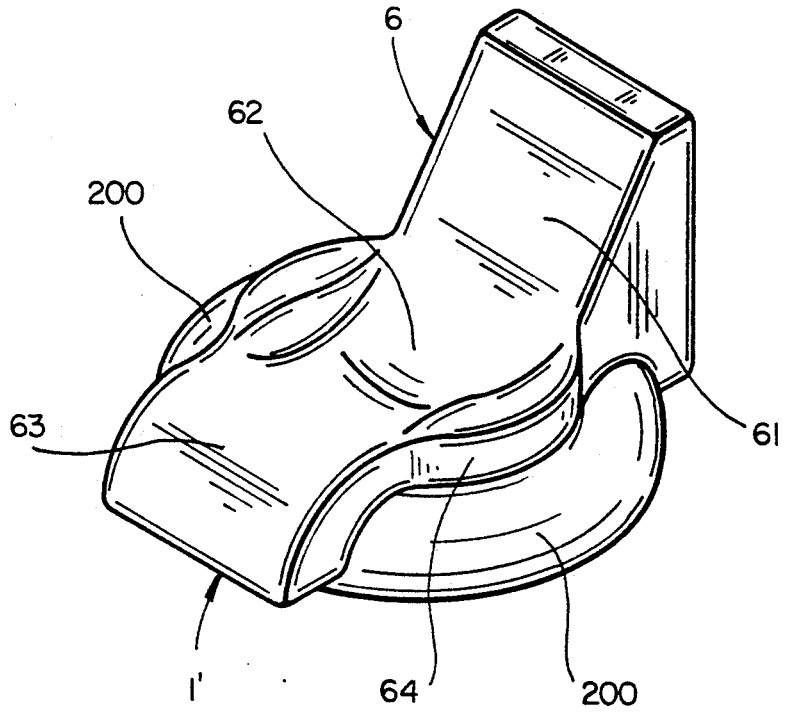
FIG. 5 shows a perspective view of a flotation device including an insert and an inner tube.
Figure 9:
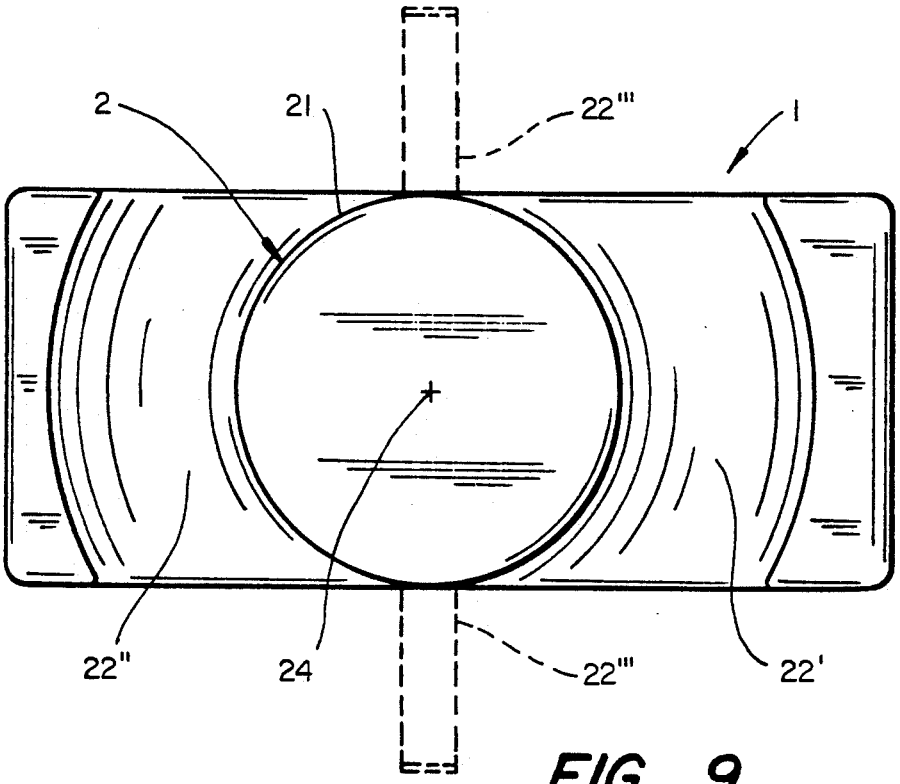
FIG. 9 shows a bottom view of an insert without armrests.

Returning to FIG. 3, the bottom portion 2 further includes one or more contoured, concave surfaces 22 radially disposed about the circular base. The bottom portion 2 is of a cross-sectional shape similar to the underside of a mushroom and permits an inflated inner tube to be fitted around the circular base 21 and on the surfaces 22. The extent to which the concave, contoured surfaces 22 constitute a single surface or several surfaces is subject to multiple interpretations. Comparison of FIGS. 4 and 9 illustrate the definitional difficulty. FIG. 4 depicts the insert 1' with armrests 64, 64 from the bottom and FIG. 9 depicts the insert 1 without armrests from the bottom. It is also possible to construct an insert with structures (not shown) that merely define the outer edges of the seat 62 and the backrest 61 but are not armrests, yet extend radially outward from the circular base 21. The insert 1 without armrests appears to have two, discontinuous surfaces 22', 22'' whereas the insert 1' with armrests appears to have a single, continuous surface 22. It is also possible to construct surfaces 22''', such as is shown by dashed lines in FIGS. 1 and 9, to extend radially from the insert for distributing loads about an inner tube more evenly.

The contoured, concave surfaces 22 permit easy installation of an insert 1 into the center-hole of a tube. Because the surfaces 22 conform to the shape of the tube, the insert 1 is usable in conjunction with a tube with or without means for fastening the insert to the tube, the insert being supported by and retained in the tube by means of gravity and/or friction. Further, the insert is supported by a tube without the necessity of deforming and possibly damaging the tube.

The insert of the present invention is easily mounted by a passenger because the weight distribution of the insert is such that the center of gravity of the insert is located on a vertical axis passing through or near the center of the circular base 24. When a flotation device is formed by placing an insert in the center hole of an inner tube, the flotation device remains in an upright position in water for easy mounting.

Further, the flotation device remains in substantially the same position after being mounted by a passenger (provided the passenger is within a certain range of weight and heights) as its position before mounting. This is because the insert is constructed such that the normally seated passenger's weight distribution, in conjunction with the weight distribution of the insert and the inner tube, provides a center of gravity of the flotation device with a passenger that is located on a vertical axis passing through or near the center of the circular base 24. Stability, and to some extent the center of gravity, can also be changed by inflating or deflating the inner tube, particularly relative to the size, weight and desired portion of the user.

Figure 10:
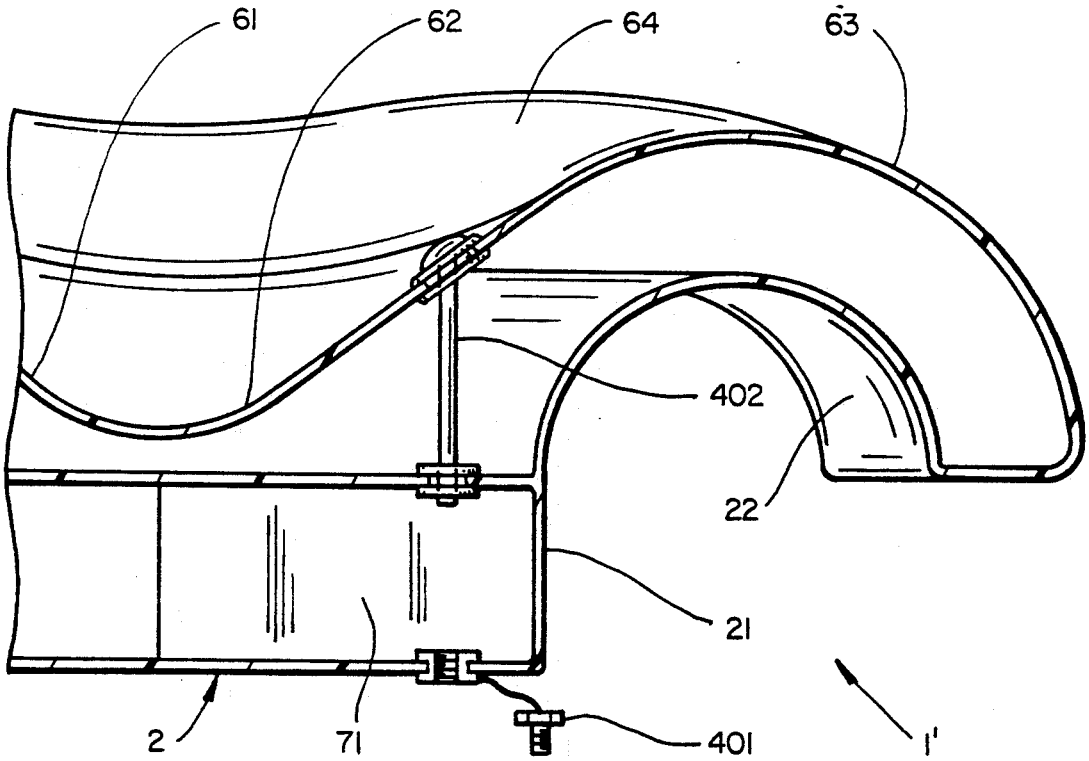
FIG. 10 shows a cross-sectional view of an insert with a ballast compartment.

A passenger may desire to recline further back, to sit further forward, or to otherwise adjust the location of the center of gravity and center of buoyancy of the flotation device, perhaps to accommodate a heavy load on one side of the flotation device or for any variety of reasons. An embodiment of the invention, depicted in part in FIG. 4, is provided with a ballast portion 70 comprising a number of compartments 71, which may be shaped in the form of segments of a circle, as shown in FIG. 4, or any other shape, such as a number of squares, that is desired. Each compartment 71 includes a draining and filling valve apparatus 72 with which the passenger can fill one or more of the compartments 71 with water as desired to relocate the center of gravity of the flotation device. Similarly, the passenger may use the draining and filing valve apparatus 72 to drain water from a compartment. While elaborate structures for a draining and filling valve apparatus 72 are possible, one simple structure consists of an upper valve 402 and a lower valve 401 mounted through the walls of the compartments, such as is shown in FIG. 10. When the lower valve 401 is opened it is difficult for water to enter the compartment 71 because of air pressure within the compartment. When the upper valve 402 is opened, air is released from the compartment 71 and water is allowed to flood the compartment until the upper valve 402 is closed, the water providing ballast for the insert. The center of gravity of a flotation device with a flooded compartment shifts toward that compartment. Water is drained from the compartment by removing the flotation device from the water and again opening the valves until the water drains out. While a manually operated valve apparatus 72 is described above, it is obvious to one skilled in the art to modify the above structure to be remotely operated, such as with a hand-held solenoid (not shown) for opening and closing the valves 401 and 402 and a hand or foot pump (not shown) or compressed air sources (not shown) for forcing air into the compartment 71 to drain the compartment more quickly and to drain the compartment while the device is in the water.

Normally the insert 1 fits snugly in an inner tube. However, a flotation device may be used under conditions that risk the tube and the insert becoming separated, or the insert may be used with a tube that is larger than the tube for which the insert was intended. To ensure that the insert remains properly seated in any size tube, fastening means are provided in another embodiment of the invention. FIG. 6 depicts an insert 1 used with a too-large tube 200. The insert 1 is secured to the tube with fastening means comprising a number of straps 100 disposed radially about the periphery of the insert. Four straps 100 are shown, and this quantity should be more than adequate for most uses, but additional straps are possible. Beside straps, other embodiments of fastening means include helically wound ropes or belts (not shown), clamps (not shown), and brackets (not shown).

The insert is also provided with a selection of one or more means for making the use of a flotation device a more pleasurable experience. Embodiments of the present invention, such as is depicted in FIG. 3, include an insert provided with a beverage holder 52 disposed at a convenient location on the seat portion 6 for holding a beverage, an umbrella holder 51 disposed at a top portion of the backrest 61 for holding an umbrella (not shown) for shading purposes, one or more handgrips 53 disposed along the seat portion 6 for gripping while the flotation device traverse rough water and for carrying the flotation device, and one or more recesses 55 for a stereo device and a storage compartment 81 disposed behind the backrest 61 between the seat portion 6 and the bottom portion 2 as shown in FIGS. 3 and 4. The storage compartment may be provided with an outwardly opening door 82 for making the storage compartment watertight. Additionally, the seat portion can be adapted to contain means for draining water from the seat so the user is not always sitting in a water filled seat.

Figure 7:
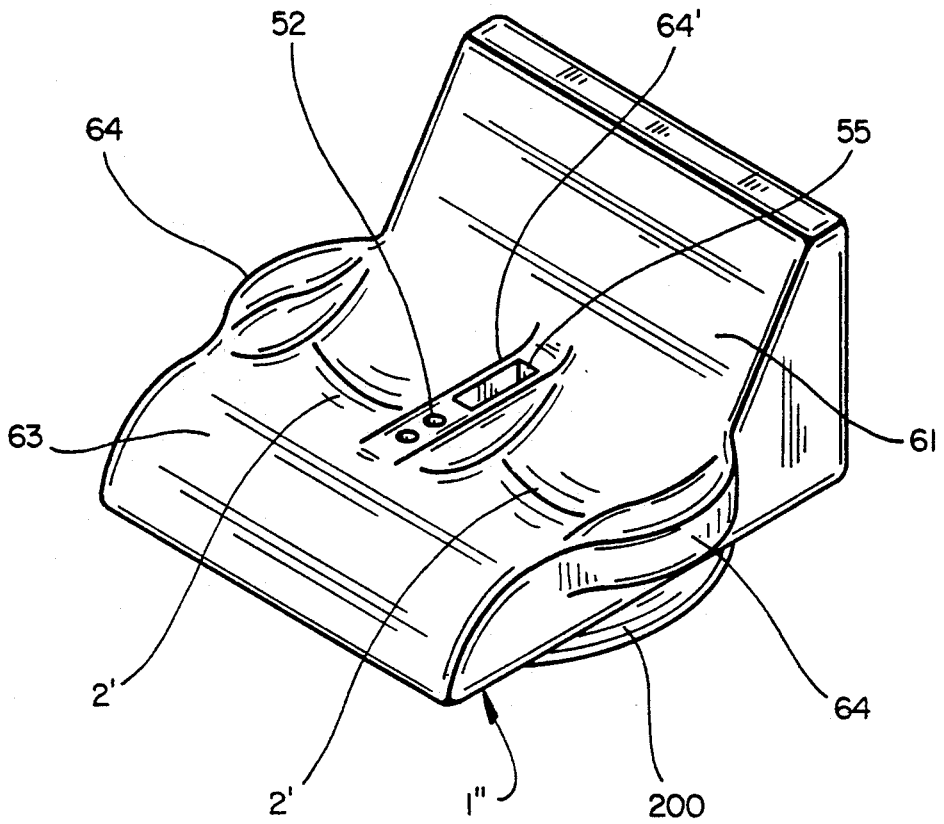
FIG. 7 shows a perspective view of a multiseat flotation device.

The foregoing descriptions of an insert for an inner tube discuss an insert with a single seat, but are equally applicable to an insert comprising more than one seat for more than one passenger. FIG. 7 shows an insert 1" and a tube 200 where the insert 1" and a tube 200 where the insert 1" comprises two seats 2', 2'. In this embodiment, the two seats 2', 2' are separated from one another by a console 64'. The console 64' may be equipped with such options as beverage holders 52, stereo speaker or radio holders 55, umbrella holders 51 and grips 53, to list but a few options.

FIG. 7 depicts a two seat 2', 2' insert 1", however, other embodiments of the invention include multiseat inserts with more than two seats, wherein seats alternate in opposite directions (not shown), and multiseat inserts without consoles 64' (not shown). The size of the insert and the number of seats that it is capable of including is limited only by the size of the tube.

Figure 8:
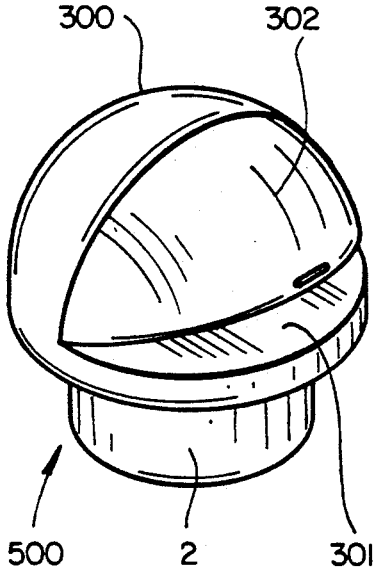
FIG. 8 shows a perspective view of an insert for storing equipment or supplies.

The foregoing descriptions of an insert for an inner tube describe inserts including seating portions for seating one or more passengers. However, in another embodiment of the present invention an insert for storage of equipment or supplies is provided. FIG. 8 shows an insert 500 for storage of equipment or supplies. In this embodiment of the invention, a bottom portion 2 and a top portion 300 have a hollow interior portion 301. The interior portion 301 is accessible by an access means such as a retractable door 302. FIG. 8 shows a top portion 300 with hemispherical shape, but other embodiments include conical, cylindrical, square and pyramidal shaped top portions, to illustrate the possibilities. The access means need not comprise a retractable door 302, but may alternatively comprise a hinged door (not shown) or a threaded cap (not shown).

While the present invention has been described with respect to its various and preferred embodiments, it is not intended to limit such invention by the description given. Various alternative embodiments not specifically described will be readily apparent to those skilled in the art, and it is intended that they be embraced within the scope of the invention, insofar as the appended claims may permit.

What is claimed is:

1. An insert for an inflatable, buoyant toroid comprising:

a bottom portion, the bottom portion including at least one contoured, concave surface radially disposed about a base, the contoured concave surface being adapted for engaging a portion of a surface of the buoyant toroid, the base being fittable within a center opening of the buoyant toroid; and seating means including a backrest, a seat, a legrest, a left side, and a right side, the seating means being disposed relative to the bottom portion such that at least a portion of the seat is disposed above the base, between the backrest and the legrest, and at least a portion of the backrest and the legrest overlies at least a portion of the contoured concave surface when the insert is in an upright position.

2. An insert as in claim 1, wherein a center of gravity of the insert is located substantially on a vertical axis passing substantially through a center of the base when the insert is in an upright condition and when a passenger is seated in a normal manner in the seating means.

3. An insert as in claim 1, wherein the base is circular in shape.

4. An insert as in claim 3, wherein the center of gravity of the insert is located on the vertical axis passing substantially through the center of the circular base when the seating means are empty.

5. An insert as in claim 3, further comprising a buoyant toroid having the insert positioned in the buoyant toroid thereby providing a flotation device having positive stability when floating in water.

6. An insert as in claim 1, wherein the left side and the right side of the seating means comprise armrest means.

7. An insert as in claim 1, further comprising ballasting means for adjusting the locations of a center of gravity and a center of buoyancy.

8. An insert as in claim 7, wherein the ballasting means includes a plurality of separate compartments disposed between the bottom portion and the seating means, the plurality of separate compartments each being provided with a filling and draining means for filling and draining the compartments with water.

9. An insert as in claim 1, further comprising a plurality of fastening means for fastening the insert to the buoyant toroid, the fastening means being radially disposed about the periphery of the insert.

10. An insert as in claim 1, further comprising a storage compartment disposed in a space between the backrest and the bottom portion.

11. An insert as in claim 10, wherein the storage compartment is watertight.

12. An insert as in claim 1, further comprising a holding means for holding a beverage container in an upright condition.

13. An insert as in claim 1, further comprising an umbrella holder.

14. An insert as in claim 1, further comprising gripping means for gripping the insert by hand.

15. An insert as in claim 1, wherein the seating means provides seating for two persons.

16. An insert as in claim 15, wherein the seating means includes seating for two persons side by side facing in the same direction.

17. An insert as in claim 15, wherein a separating armrest means separates more than one seat.

18. An insert for an inflatable, buoyant toroid comprising:

a bottom portion, the bottom portion including a hollow interior portion and an exterior side formed with at least one contoured, concave surface adapted for engaging a portion of a surface of the buoyant toroid, and a base about which the contoured, concave surface is radially disposed, the base being fittable within a center opening of the buoyant toroid;

a top portion attached to the bottom portion and enclosing the hollow interior portion of the bottom portion; and door means formed in the top portion for providing access to the interior portion, the door means being movable between an opened position for allowing access to the interior portion and a closed position for preventing access to the interior portion.

19. An insert as in claim 18 further comprising a buoyant toroid having the insert positioned in the buoyant toroid thereby providing a flotation device having positive stability when floating in water.

* * * * *